US005839127A

United States Patent [19]

Curiel

[11] Patent Number: 5,839,127

[45] Date of Patent: Nov. 24, 1998

[54] ODOR EXTRACTOR APPARATUS

[76] Inventor: Jesus M. Curiel, 16537 W. Delhi Ave., Delhi, Calif. 95315

[21] Appl. No.: 961,669

[22] Filed: Oct. 31, 1997

[51] Int. Cl.[6] ..... E03D 9/04

[52] U.S. Cl. ..... 4/216; 4/213

[58] Field of Search ..... 4/213, 216, 209 R, 4/211

[56] References Cited

U.S. PATENT DOCUMENTS

| | | | |
|---|---|---|---|
| 3,681,790 | 8/1972 | Dooley | 4/213 |
| 4,318,192 | 3/1982 | Williams et al. | 4/213 |
| 5,369,810 | 12/1994 | Warren | 4/213 |
| 5,718,005 | 2/1998 | Ng | 4/213 |

*Primary Examiner*—David J. Walczak
*Attorney, Agent, or Firm*—J. Sanchelima

[57] ABSTRACT

An improvement for toilet assemblies wherein an odor extractor device is connected to the overflow tube of the toilet assembly. The water supplied through a conduit to the overflow tube is discharged on a tubular member that is connected to an opening on the lateral wall of the overflow tube. A flexible sheet is mounted over the opening, on the internal surface of the lateral wall of the lateral wall of the overflow tube. The flexible sheet maximizes the suction applied to the bowl rather than the tubular member so that the gases typically associated with these excretory functions are extracted through the conventional drain apertures found in bowls.

2 Claims, 1 Drawing Sheet

ODOR EXTRACTOR APPARATUS

BACKGROUND OF THE INVENTION

1. Field of the Invention

The present invention relates to an odor extractor apparatus, and more particularly, to the type that is installed in a toilet.

2. Description of the Related Art

Many odor extractors exist nowadays, but none of them disclose an odor extractor apparatus that extracts the air from the overflow tube in. To the best of applicant's knowledge the extractors available today extract the air from surrounding of the toilet, typically after a user has already been exposed to undesirable odors. The present invention extracts the air from the bowl.

SUMMARY OF THE INVENTION

It is one of the main objects of the present invention to provide an apparatus that extracts the gases discharged from the humans in a toilet seat.

It is another object of this invention to provide an apparatus that can be installed to a conventional odor extractor for rooms.

It is yet another object of this invention to provide such a apparatus that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
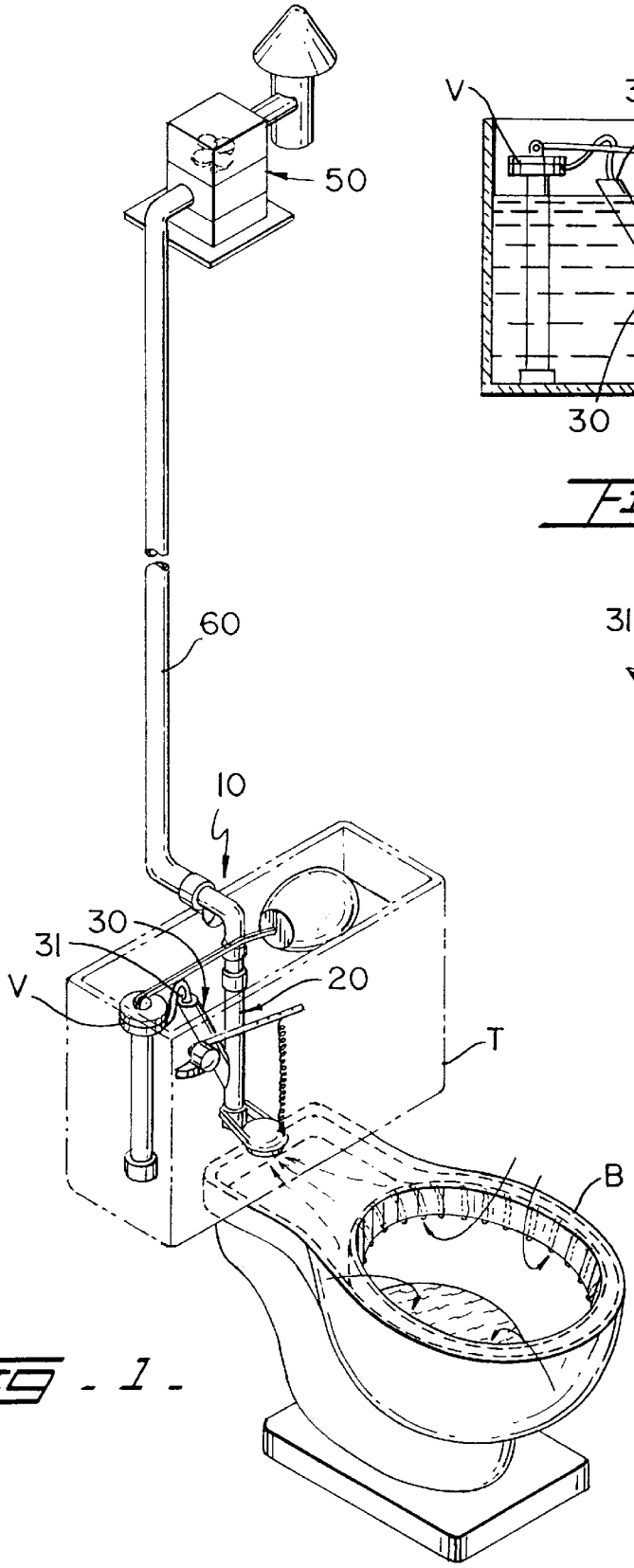
FIG. 1 represents the preferred application of the present invention.
Figure 2:
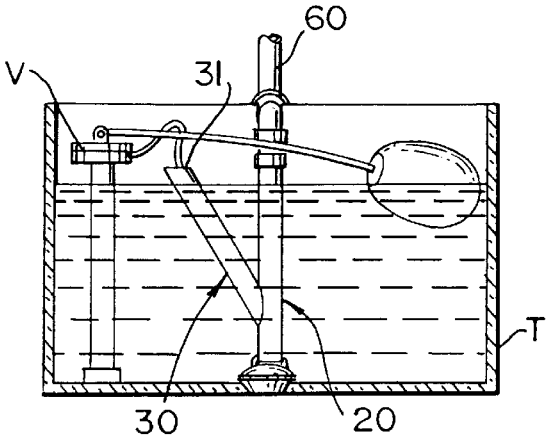
FIG. 2 is a cross sectional view of a toilet tank, showing the odor extractor apparatus.

Referring now to the drawings, where the present invention is generally referred to with numeral 10, it can be observed that it basically includes overflow tube 20 connected to tubular member 30 and flexible sheet 40 to cover opening 22 that connects them together. An extractor 50 is connected to tubular member 30 through circuit 60.

Odor extractor apparatus 10 is partially installed inside toilet tank T and connected to toilet bowl B through the overflow conduit. Apparatus 10 basically comprises overflow tube 20 and tubular member 30 that is mounted at angle. The gases and odors typically present in and around toilet bowl B are extracted through drain outlets found in conventional bowls B, under the rim overflow tube 20 to the exterior. Overflow tube 20 then functions as a suction tube that is connected to extractor 50 through conduit 60.

Tubular member 30 is rigidly mounted to the side of overflow tube 20 and receives the water coming from valve V until a predetermined level is achieved inside tank T. Opening 22, in the preferred embodiment, connects overflow tube 20 and tubular member 30 and is covered by flexible sheet 40.

Figure 3:
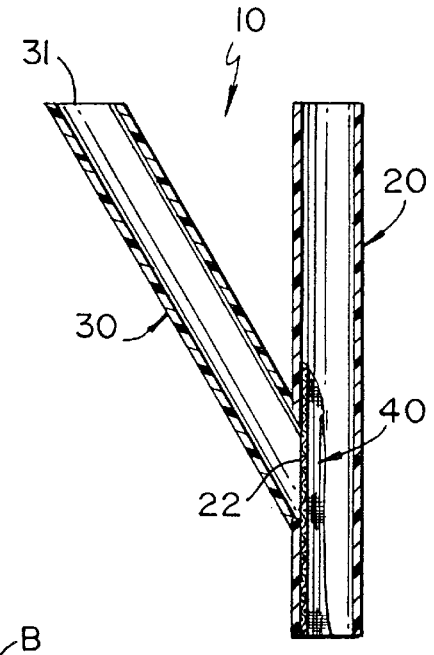
FIG. 3 is a partial cross sectional view of the odor extractor apparatus, showing a flexible sheet.

As shown in FIG. 3, flexible sheet 40 is made out of a vinyl material and is designed to cover opening 22 when odor extractor 50 is on. In this manner, the gases do not travel through overflow tubular member 30 and out through end 31 avoiding the undesirable bad odor inside toilet tank T. In other words, flexible sheet 40 forces the gases to exit to the exterior through extractor 50. Flexible sheet 40 is mounted on the internal surface of lateral wall of tube 20 and immediately above opening 22 so that the water coming from tubular member 30 is not obstructed as it is discharged on overflow tube 20, and more important, the extracted air will come from the bowl. Flexible sheet 40 falls down beyond opening 22. Since sheet 40 is wet, most of the time, this tends to weigh it down or even adhere it to the surface of overflow tube 20 below opening 22, thus preventing or minimizing the air extracted from tubular member 30 for maximum suction efficiency.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An improvement in a toilet assembly that includes a water tank, a bowl, a water conduit with an outlet having a valve and a vertically extending overflow tube within said tank that discharges water in said bowl, said overflow tube having a lateral wall with an internal surface, the improvement comprising means for extracting the air from said overflow tube and said overflow tube including an opening on said lateral wall and further including a tubular member having first and second ends, said first end mounted to said lateral wall so that said opening is covered by said first end and said second end being connected to said outlet so that the water released by said valve is received by said tubular member and carried to said overflow tube wherein said overflow tube includes a flexible sheet mounted on the internal surface of said lateral wall and immediately above said opening so that the water coming from said tubular member is not obstructed as it is discharged on said overflow tube and the air extracted comes primarily from said bowl.

2. The improvement set forth in claim 1 wherein said flexible sheet is made out of a vinyl material.

* * * * *